United States Patent [19]

Silbernagel

[11] Patent Number: 4,711,069

[45] Date of Patent: Dec. 8, 1987

[54] STRETCH FOIL WRAPPING ARRANGEMENT

[75] Inventor: Peter Silbernagel, Ochtrup, Fed. Rep. of Germany

[73] Assignee: B. Hagemann & Co., Steinfurt, Fed. Rep. of Germany

[21] Appl. No.: 889,590

[22] Filed: Jul. 25, 1986

Related U.S. Application Data

[63] Continuation of Ser. No. 663,392, Oct. 22, 1984, abandoned.

[30] Foreign Application Priority Data

Oct. 20, 1983 [DE] Fed. Rep. of Germany ..... 3338036

[51] Int. Cl.[4] ..... B65B 53/00

[52] U.S. Cl. ..... 53/556; 53/588

[58] Field of Search ..... 53/203, 210, 441, 556, 53/587, 588, 591; 198/458, 782; 493/297, 298, 299, 300, 301

[56] References Cited

U.S. PATENT DOCUMENTS 4,050,220 9/1977 Lancaster et al. ..... 53/550 X
4,178,734 12/1979 Lancaster et al. ..... 53/441 X
4,317,322 3/1982 Lancaster et al. ..... 53/588 X

*Primary Examiner*—E. R. Kazenske
*Assistant Examiner*—Michael D. Folkerts
*Attorney, Agent, or Firm*—Cushman, Darby & Cushman

[57] ABSTRACT

A stretch foil wrapping arrangement for wrapping objects. The objects are conveyed to a transition bridge around which a stretch foil tube is wrapped. As the objects are conveyed through the transition bridge they pass inside of the tube which is out after the object and tube portion in which it is wrapped leave the transition bridge. The transition bridge includes upper and lower conveyors each having an outer actively driven belt and an inner passively driven roller plane in contact with the objects.

13 Claims, 4 Drawing Figures

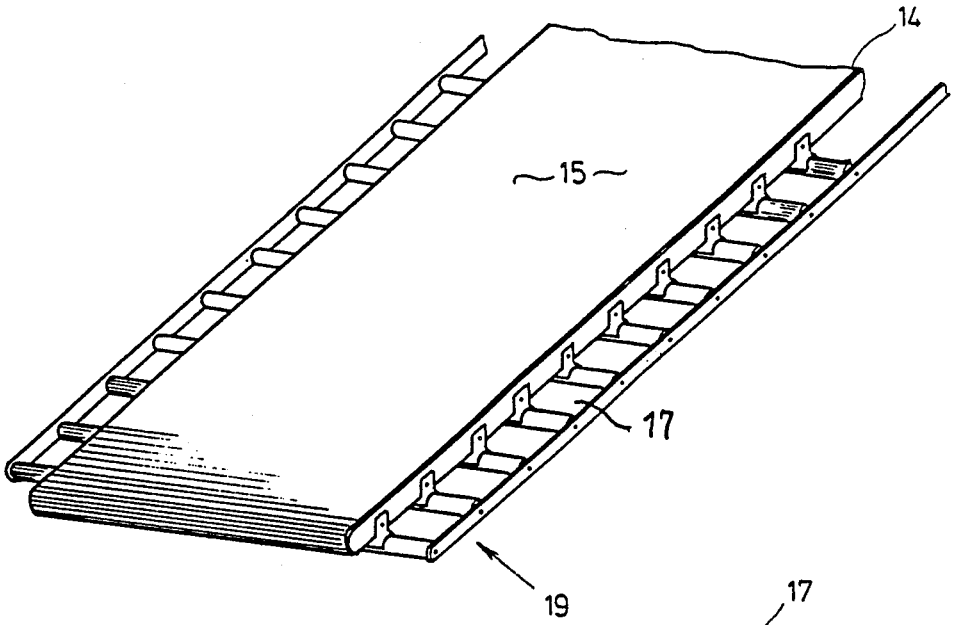
Fig. 2
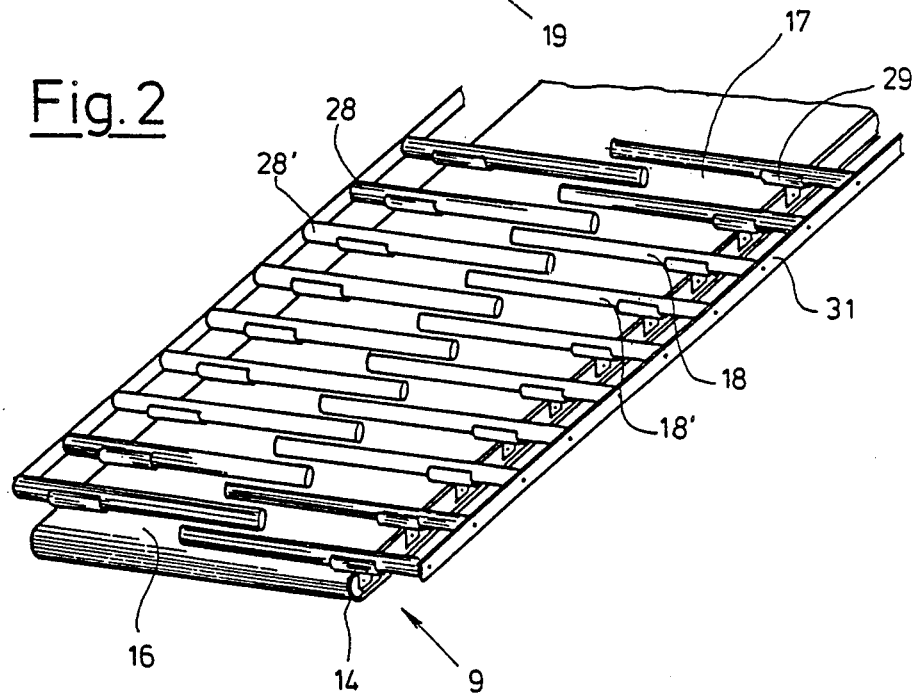

STRETCH FOIL WRAPPING ARRANGEMENT

This is a continuation of application Ser. No. 663,392, filed Oct. 22, 1984, which was abandoned upon the filing hereof.

RELATED APPLICATIONS

U.S. application Ser. No. 665,063, entitled TWIN-ROLL LAMINATED PACKAGING PROCESS AND APPARATUS, filed Oct. 26, 1984, (based on German P33 39 337.0) describes and claims an invention in the same general art area.

BACKGROUND OF THE INVENTION

The invention relates to apparatus for wrapping objects such as packs or bundles in a stretch foil, whereby the foil is drawn off from at least one delivery spool under tractive force and is then led around a winding cross-section. A transition conveyor is covered with foil and includes at least two conveyor belts arranged parallel one on top of the other. The lower one of these is designed as an actively driven conveyor belt with an outer side which is covered with the wrapping foil upon passing through the wrapping area, to form a tube of foil through which the objects to be wrapped pass. The upper conveyor belt is designed as a transport device for the packs of bundles.

Shaped, after-shrunk foils, i.e. so-called stretch foils, have made a far-reaching impact on wrapping technology in recent years. A feature of these foils is that an object wrapped in them is pressed together as a result of the remaining foil tension without the foil tearing. Thus, wrapping technology with the type of shaped, after-shrunk foil differs significantly from the using heat-shrunk foils.

In U.S. Pat. No. 4,050,220, an apparatus for wrapping packages is set forth with two conveyor belts arranged in a V-form for transporting objects to be wrapped to the wrapping station. Fixed guide rails are provided for the transport through the wrapping station. These guide rails are wrapped with foil, whereby the foil slides along the outer side of the guide rails as the packages move forward, and then slips off the guide rails at the end without any interruption. Because of the inherent tension, the foil then places itself onto the surface of the package units. The disadvantage of the fixed guide rails is that the foil clings to the guide rails as a results of the static electricity and cling effect, which then causes problems with the foil sliding off.

The concept set forth in U.S. Pat. No. 4,050,220, has been further developed (compare DE-OS No. 31 19 657). In the more advanced device, a transition conveyor has been provided which extends through the track of the winding tape lead apparatus and extends all the way through the lead apparatus without interruption. The transition conveyor consists of at least two conveyor bands arranged in a parallel position one above the other; the lower of these is designed as an actively driven conveyor with an outer side which is covered with the wrapping foil upon passage through the wrapping area, bringing the foil out. The upper conveyor belt is designed as a transport device for the packages. This permits a uniform forward movement of both packages and foil. The invention set forth here distinguishes itself from the familiar, above mentioned device.

In the apparatus described in DE-OS No. 31 19 657, the package units are always pushed in a certain direction through the wrapping in coils; thus, in the case of cartons loosely piled onto each other, which are to be grouped into a larger bundle, the positioning can slip and can even be grouped into a larger bundle, the positioning can slip and can even result in the dislodging of individual packages. In addition, a package unit can become damaged in its construction.

SUMMARY OF THE INVENTION

An objective of the invention is to improve on the above-described apparatus so that loosely layered bundles or package units can be wrapped reliably using a stretch foil.

This objective is accomplished by providing a second transition conveyor with the same design as the first to support the packages or bundles from above, whereby the inside conveyor is designed as a gliding plane or as a passively driven rolling plane for the packages or bundles.

The two transition conveyors should preferably be arranged horizontally and parallel to one another; some deviation, however, can be made from the horizontal position to a slight diagonal placement.

The arrangement of the invention deviates markedly from both the fixed guide rails in U.S. Pat. No. 4,050,220 and from the principle of the double conveyor belt as set for the in DE-OS No. 31 19 657. In particular, the transfer of power from the conveyor belt surface to the package units and the resulting, surprisingly uniform transport of the packges and the covering of them with foil is a significant step which simplifies the device and improves the operation.

The two transition conveyors forming the transition bridge are arranged above and below the package units, which is a reliable way to prevent the sliding and displacement of loosely piled pieced in a bundle. In addition, varying bundle sizes can be accomodated simply by altering the distance between the transition conveyors (means for altering not shown).

It is possible to make the gliding or roller plane wider than the conveyor belt when viewed from a diagonal to the direction of movement. In this case, during the actual wrapping process, the wrapping foil is already positioned at the sides of the package unit and is still in contact with the conveyor belt at the upper and lower sides.

The terms "gliding plane" and "roller plane" refer generally to so-called rolling conveyor planes equipped with positioned ball bearings or parallel roller rods, as in common in conveyor technology.

Above all, when adjustable roller rods housed in split bearings are used, it is possible to alter the width of the roller planes. In so doing, one might choose, for example, a dovetailing, overlapping roller rod arrangement, whereby one half of the roller rods can be shifted to one side and the other half to the other side.

It is also possible to connect at least two of the roller rods, positioned next to each other in split bearings, on their outer side over a crossover and to tape bore mount (i.e., and journal-bearing mounted) them on the outside.

BRIEF DESCRIPTION OF THE DRAWINGS

The presently preferred emobidment will be described with reference to the figures, which depict the following:

FIG. 2 is a perspective view of the significant parts of the transition bridge including two conveyors in an enlarged illustration;

DETAILED DESCRIPTION OF THE PREFERRED EMBODIMENT

Figure 1:
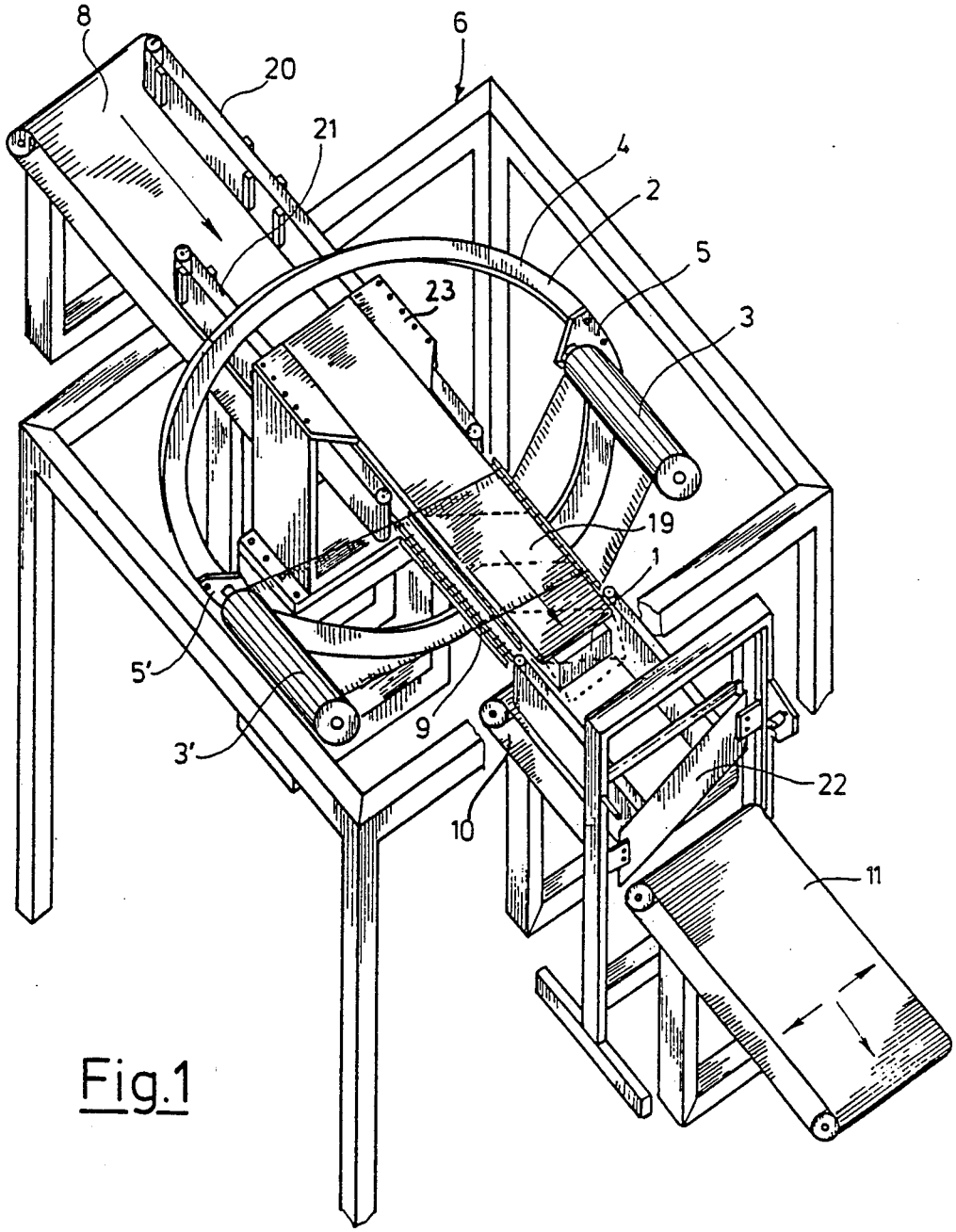
FIG. 1 is a perspective view of the present invention.

Referring now to FIG. 1 there is shown a perspective drawing of an apparatus, according to the invention, to wrap package units 1. A wrapping foil leading device 2, is wrapped with a foil 3, which consists of a stretch foil strip. This is achieved with the help of a chain drive 5, which is lead around a rim 4 and which rotates during the wrapping on the fixed track of the rim 4 around the package 1 at a distance from the package. In order to increase the wrapping speed, a second rotating chain drive 5' of the same design is provided, with which a foil 3' can be wrapped.

In the area of a wrapping station 6, there is provided a belt feeder 8, a line conveyor belt 10 and an extension driving band 11, and two transition conveyors 9 and 19. The two transition conveyors together form the transition bridge. As is clear from the diagram, transition conveyor 9 is positioned below package unit 1, while the other transition conveyor 19 is above it. Both transition conveyors together form the transition bridge, which supports the package units; the foil tape 3, 3' is under tension and is wrapped around the transition bridge to form a tube with an inside diameter which is larger than the axial projection of the package unit 1 to be wrapped. Details as to the transition bridge are illustrated further below.

The constantly incoming package units 1 are placed in the continually forming tube, whereby the coiler tube places itself next to the package unit after the running over of the transition bridge under remaining foil tension, which is illustrated roughly. That is, the constantly incoming package units 1 are placed in the continually forming tube, whereby the tube adheres itself to the package unit as above-described and as illustrated in the Figures. In addition, lateral boundary belts 20, 21 are provided in order to guide the package units more precisely in the transition region from the belt feeder 8 to the wrapping station 6. Between the line conveyor belt 10 and the extension driving band 11, there is also a cutting station 22 equipped with a drop knife. The severing of the foil tube is relatively uncomplicated, since the tube is under tension and moves up to and joins the package unit as soon as it has been cut. Nonetheless, there are other pinching, cutting and refining devices which have been proven in the technology of wrapping devices, and these can also be used here advantageously.

Figure 3:
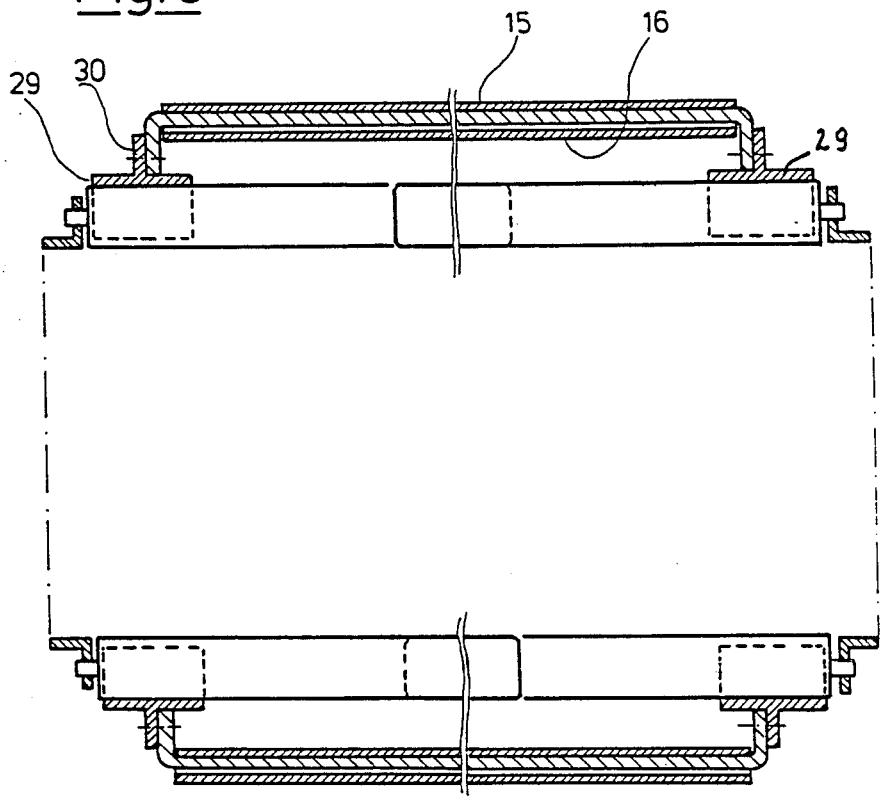
FIG. 3 is a cross section through the upper part of the transition bridge.

The two transition conveyors 9 and 19 correspond to those which are illustrated in detail in FIGS. 2 and 3. They are hung in a cantilevered manner on a frame section 23.

Referring now to FIG. 2, the transition bridge consists of two transition conveyors 9, 19; each one of these has two parallel conveyance sections, i.e. an external conveyor belt 14, each with an outer and inner side. The conveyor belts 14 of the transition conveyors are actively driven. The speed of movement on the conveyor belt also determines the feeding of the package units. In addition, each transition conveyor 9, 19 consists of an internal, passively driven gliding or roller plane 17, which is equipped with roller rods 18, 18' and 28, 28' in the operational example. The roller rods can be, for example, polypropylene cylinders, which are moveable axially and are housed in split bearings.

Figure 4:
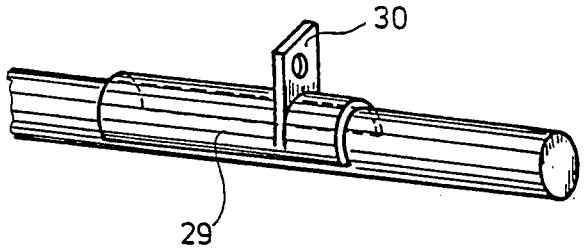
FIG. 4 is a detail of the mounting of the roller rods of the transition bridge conveyors.

Referring now to FIG. 4, there is shown an enlarged detail showing a type of split bearing 29 which is fastened onto a frame with a clamp 30. The package unit 1 is supported and guided in the wrapping area between the roller planes formed by the roller rods. The wrapping foil 3 places itself on the outer side 15 of the transition conveyor 9 or 19. By means of the tube which forms as well as the wrapping foil placed against the sides of the package units, the power from the conveyor belt is transferred and the package unit is thus propelled over the roller plane.

As shown in FIGS. 2 and 3, the roller rods form cogged configurations, with dovetailing formed by the roller rods and a cog ridge formed by the crossover 31. Inside the split bearing 29, the roller rods can be shifted to overlap axially toward the direction of transport, whereby the width of the roller plane is adjustable.

Normally, the width of the roller plane is greater than that of the conveyor belt. The roller rods are connected at the outer side to the crossover 31 and are also tape bore mounted to it, as can be seen in FIG. 2.

All this results in an apparatus which exhibits reliability in wrapping loose bundles without shifting the structure. Slippage can not occur between the advanced conveyor and the package units to be transported since the package units move foreward only on a passively driven roller conveyor.

Other embodiments and modifications of the present invention will be apparent to those of ordinary skill in the art having the benefit of the teaching presented in the foregoing description and drawings. It is therefore, to be understood that this invention is not to be unduly limited and such modifications are intended to be included within the scope of the appended claims.

What is claimed is:

1. A stretch foil wrapping arrangement comprising:

a wrapping station structure defining a place whereat an object is to be wrapped with a stretch foil;

belt feeder means for conveying said object to said wrapping station;

a transition bridge for receiving said object from said belt feeder means and conveying it through said wrapping station, said transition bridge including first and second transition conveyors positioned so as to be substantially parallel to one another, each transition conveyor including an internal roller plane having an inner portion or an internal roller plane of the other transition conveyor, and an external belt located on a side of each of said first and second transition conveyors opposite said inner portion of said internal roller plane, each said roller plane being adapted to permit the conveyance of said object;

means for wrapping stretch foil around said transition bridge and said external belts associated therewith so as to form a continuous tube of foil;

means for driving said external belts;

said object being conveyed with said tube by edgewise contact with said continuous tube of foil; and a cutting station, positioned substantially adjacent to said transition bridge, for receiving said continuous tube with said object therein and cutting said tube, the stretch foil then adhering closely to said object.

2. An arrangement according to claim 1 wherein said transition conveyors are positioned substantially horizontally, one above the other.

3. An arrangement according to claim 1 wherein said roller planes are wider than said external belts.

4. An arrangement according to claim 1 wherein said roller plane comprises a plurality of roller rods, a frame structure, and a split bearing associated with each roller rod for rotatably coupling it to said frame.

5. An arrangment according to claim 4 wherein said frame structure includes a crossover member and each roller rod is tape bore mounted to said crossover member.

6. Apparatus for wrapping an object in a stretch foil whereby the foil is drawn off at least one delivery spool under tractive force and is then led around a winding track comprising:

wrapping apparatus feeder means for conveying said object to a transition bridge located within said winding track;

said transition bridge comprising two spaced apart parallel transition conveyors, each transition conveyor comprising at least two conveyors, and said transition brige having one of said transition conveyors positioned below said object and the other positioned above said object, each of said transition conveyors comprising, (i) a passive roller plane (ii) a conveyor belt with means for driving said belt, said passive roller plane being positioned so as to be in direct contact with said object and said conveyor belt being positioned so as to be in direct contact with said foil.

7. Apparatus according to claim 6 wherein said passive roller plane comprises a plurality of roller rods, a frame structure, and a split bearing associated with each roller rod for rotatably coupling it to said frame.

8. Apparatus according to claim 7, wherein the roller rods are movable and are held in split bearings.

9. Apparatus according to claim 8, wherein said frame structure includes a cross over member and where at least two rolling rods are positioned next to one another and are tape bore mounted to said crossover member.

10. Apparatus for wrapping packs or bundles in a stretch foil, whereby the foil is drawn off at least one delivery spool under tractive force and is then led around a winding track comprising:

a package or bundle transition bridge, said transition bridge having an inside, carrying the packs or bundles, and an outside for leading the wrapping foil, and passing through the track of the delivery spool guide;

said transition bridge including at least two conveyor belts arranged in parallel, one on top of the other, each conveyor having an inside, facing the bundles, and an outside, in contact with the foil;

the inside of each conveyor being lined with a plane of passively driven rollers which allow the bundle or pack to be transported in the same direction of travel as the outside foil covered surface of the conveyor; whereby the outside conveyor surfaces of said transition bridge propel a continuously forming tube of foil within which a bundle or pack is propelled by edgewise contact with said continuously forming tube of foil and supported by said plane of passively driven rollers.

11. Apparatus according to claim 10, wherein the transition conveyors are positioned horizontally.

12. Appartus according to claim 11, wherein the plane of passively driven rollers is wider than the conveyor belt.

13. Apparatus according to claim 10, wherein the plane of passively driven rollers is wider than the conveyor belt.

* * * * *